US009352916B2

(12) United States Patent
Nishii et al.

(10) Patent No.: US 9,352,916 B2
(45) Date of Patent: May 31, 2016

(54) SHEET CONVEYING DEVICE, SHEET DISCHARGING DEVICE, AND IMAGE FORMING APPARATUS

(71) Applicants: Toshikane Nishii, Osaka (JP); Haruyuki Honda, Kanagawa (JP); Masanori Namba, Kanagawa (JP); Mitsutaka Nakamura, Hyogo (JP)

(72) Inventors: Toshikane Nishii, Osaka (JP); Haruyuki Honda, Kanagawa (JP); Masanori Namba, Kanagawa (JP); Mitsutaka Nakamura, Hyogo (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/027,478

(22) Filed: Sep. 16, 2013

(65) Prior Publication Data

US 2014/0091518 A1 Apr. 3, 2014

(30) Foreign Application Priority Data

Oct. 1, 2012 (JP) ..... 2012-219289

(51) Int. Cl.
*B65H 5/02* (2006.01)
*B65H 5/04* (2006.01)
(Continued)

(52) U.S. Cl.
CPC ..... *B65H 5/068* (2013.01); *B65H 5/062* (2013.01); *B65H 29/14* (2013.01); *B65H 29/52* (2013.01); *B65H 29/70* (2013.01); *B65H 31/14* (2013.01); *B65H 2301/51214* (2013.01); *B65H 2402/545* (2013.01); *B65H 2404/1115* (2013.01); *B65H 2404/1317* (2013.01); *B65H 2404/143* (2013.01); *B65H 2404/144* (2013.01); *B65H 2404/1526* (2013.01); *B65H 2404/63* (2013.01);
(Continued)

(58) Field of Classification Search
CPC ..... B65H 5/062; B65H 2601/11; B65H 2511/22; B65H 2511/224; B65H 2404/143; B65H 5/068; B65H 29/70; B65H 2404/1526; B65H 2404/63; B65H 2404/144; B65H 2301/51214; B65H 2515/81
USPC ..... 271/272–274
See application file for complete search history.

(56) References Cited

U.S. PATENT DOCUMENTS 4,195,832 A * 4/1980 Krumrey ..... G03B 42/045 271/272
5,351,945 A * 10/1994 Asakawa ..... B65H 3/5261 271/118
(Continued)

FOREIGN PATENT DOCUMENTS

JP 02132033 A * 5/1990
JP 2005-263418 9/2005
(Continued)

*Primary Examiner* — Prasad Gokhale
(74) *Attorney, Agent, or Firm* — Harness, Dickey & Pierce

(57) ABSTRACT

A sheet conveying device includes a first rotating member, a second rotating member, and a biasing unit that biases the second rotating member toward the first rotating member. The first and second rotating members pinch a sheet therebetween and convey the sheet in a sheet conveying direction. The second rotating member includes a small-diameter portion that faces a conveying portion of the first rotating member, and a large-diameter portion at a position axially displaced from the conveying portion. The second rotating member can change its orientation to an orientation where a rotating shaft of the second rotating member is tilted relative to a rotating shaft of the first rotating member as viewed in the sheet conveying direction, thereby moving a position of an end portion of the second rotating member on a side of the large-diameter portion away from the rotating shaft of the first rotating member.

19 Claims, 6 Drawing Sheets

(51) Int. Cl.

| | |
|---|---|
| ***B65H 5/06*** | (2006.01) |
| ***B65H 31/14*** | (2006.01) |
| ***B65H 29/14*** | (2006.01) |
| ***B65H 29/52*** | (2006.01) |
| ***B65H 29/70*** | (2006.01) |

(52) U.S. Cl.

CPC ..... *B65H 2511/12* (2013.01); *B65H 2511/20* (2013.01); *B65H 2511/224* (2013.01); *B65H 2515/81* (2013.01); *B65H 2601/254* (2013.01); *B65H 2601/261* (2013.01); *B65H 2601/324* (2013.01); *B65H 2801/06* (2013.01); *B65H 2801/39* (2013.01)

(56) References Cited

U.S. PATENT DOCUMENTS

| | | | | |
|---|---|---|---|---|
| 5,441,253 | A * | 8/1995 | Takemoto | B65H 3/5246 271/122 |
| 7,200,356 | B2 * | 4/2007 | Kawamoto | G03G 15/6576 271/188 |
| 7,661,674 | B2 * | 2/2010 | Izuchi | B65H 5/062 271/188 |
| 2003/0085976 | A1 * | 5/2003 | Youn | B41J 13/106 347/104 |
| 2007/0069456 | A1 * | 3/2007 | Jeong | B65H 5/062 271/272 |
| 2008/0273908 | A1 | 11/2008 | Ohkubo et al. | |
| 2010/0276874 | A1 | 11/2010 | Nanno et al. | |
| 2011/0058829 | A1 | 3/2011 | Kondo et al. | |
| 2011/0058873 | A1 | 3/2011 | Honda et al. | |
| 2011/0115154 | A1 | 5/2011 | Fujiwara et al. | |
| 2011/0127707 | A1 | 6/2011 | Honda et al. | |
| 2011/0204556 | A1 | 8/2011 | Takahira et al. | |
| 2011/0217058 | A1 | 9/2011 | Honda et al. | |
| 2011/0285076 | A1 | 11/2011 | Fujiwara et al. | |
| 2011/0291353 | A1 | 12/2011 | Fujiwara et al. | |
| 2012/0104685 | A1 | 5/2012 | Nishii et al. | |
| 2012/0146281 | A1 | 6/2012 | Nishii et al. | |
| 2013/0038663 | A1 | 2/2013 | Obata et al. | |
| 2013/0106050 | A1 | 5/2013 | Nishii et al. | |
| 2013/0187334 | A1 | 7/2013 | Kimura et al. | |
| 2013/0200567 | A1 * | 8/2013 | Saito | B65H 29/14 271/306 |
| 2013/0221613 | A1 * | 8/2013 | Koike | B65H 5/062 271/272 |

FOREIGN PATENT DOCUMENTS

| | | |
|---|---|---|
| JP | 2010-006538 | 1/2010 |
| JP | 4889805 | 12/2011 |

* cited by examiner

SHEET CONVEYING DEVICE, SHEET DISCHARGING DEVICE, AND IMAGE FORMING APPARATUS

CROSS-REFERENCE TO RELATED APPLICATIONS

The present application claims priority to and incorporates by reference the entire contents of Japanese Patent Application No. 2012-219289 filed in Japan on Oct. 1, 2012.

BACKGROUND OF THE INVENTION

1. Field of the Invention

The present invention relates to a sheet conveying device that conveys sheets, and a sheet discharging device using the sheet conveying device and an image forming apparatus using the sheet conveying device or the sheet discharging device.

2. Description of the Related Art

Image forming apparatuses, such as copying machines, printing machines, facsimile machines, and multifunction peripherals having two or more functions of these machines, have a problem that when the apparatus discharges a media sheet (hereinafter, "sheet"), a leading end of the sheet can be drooped and bent, resulting in improper stacking on a sheet output tray. This can occur particularly when the discharged sheet is a thin paper sheet or a large-size paper sheet.

There are conventionally proposed techniques for solving such a problem. In the techniques, when a sheet is discharged, the sheet is bended in its thickness direction to provide rigidity to the sheet.

For instance, in Japanese Laid-open Patent Application No. 2005-263418, there is disclosed a configuration including a rigidity-providing member that lifts up a widthwise center portion of a sheet being discharged. Because rigidity is provided to the sheet by elastically bending the sheet in a manner to lift up the widthwise center portion of the sheet, the sheet can be discharged onto a sheet output tray without being bent at a leading end of the sheet.

In Japanese Patent No. 4889805 or Japanese Laid-open Patent Application No. 2010-6538, there is disclosed a configuration that includes rigidity-providing rollers (or a rigidity-providing ring) that are larger in diameter than conveying rollers. A sheet is provided rigidity by elastically bending the sheet in its thickness direction using the rigidity-providing rollers.

However, such the configurations disclosed in Japanese Laid-open Patent Application No. 2005-263418, Japanese Patent No. 4889805, and Japanese Laid-open Patent Application No. 2010-6538 have the following disadvantages. When excessive elastic bending is performed on a sheet (in particular, a thick sheet) being conveyed, the sheet can be damaged by indentation left by the elastic bending and/or friction. As a result, image quality can disadvantageously decline.

In light of the circumstance, there is a need to provide a sheet conveying device capable of lessening damage to a recording sheet-like medium (a sheet) such as a paper sheet or the like, and a sheet discharging device using the sheet conveying device and image forming apparatus using the sheet conveying device or the sheet discharging device.

It is an object of the present invention to at least partially solve the problems in the conventional technology.

SUMMARY OF THE INVENTION

It is an object of the present invention to at least partially solve the problems in the conventional technology.

According to the present invention, there is provided: a sheet conveying device comprising: a first rotating member including a conveying portion; a second rotating member configured to be arranged facing the first rotating member; and a biasing unit configured to bias the second rotating member toward the first rotating member.

In the sheet conveying device, the first rotating member and the second rotating member pinch a sheet therebetween and convey the pinched sheet in a sheet conveying direction, the second rotating member includes a small-diameter portion configured to face the conveying portion of the first rotating member, and a large-diameter portion configured to be arranged at a position axially displaced from the conveying portion of the first rotating member and having a diameter larger than a diameter of the small-diameter portion, and the second rotating member is configured to be capable of changing to an orientation where a rotating shaft of the second rotating member is tilted relative to a rotating shaft of the first rotating member as viewed in the sheet conveying direction, thereby moving a position of an end portion of the second rotating member on a side of the large-diameter portion away from the rotating shaft of the first rotating member.

The present invention also provides a sheet discharging device comprising: a first rotating member including a conveying portion; a second rotating member configured to be arranged facing the first rotating member; and a biasing unit configured to bias the second rotating member toward the first rotating member.

In the sheet discharging device, the first rotating member and the second rotating member pinch a sheet therebetween and convey the pinched sheet in a sheet conveying direction to discharge the sheet to outside of the sheet discharging device, the second rotating member includes a small-diameter portion configured to face the conveying portion of the first rotating member, and a large-diameter portion configured to be arranged at a position axially displaced from the conveying portion of the first rotating member and having a diameter larger than a diameter of the small-diameter portion, and the second rotating member is configured to be capable of changing to an orientation where a rotating shaft of the second rotating member is tilted relative to a rotating shaft of the first rotating member as viewed in the sheet conveying direction, thereby moving a position of an end portion of the second rotating member on a side of the large-diameter portion away from the rotating shaft of the first rotating member.

The present invention also provides an image forming apparatus including the above-mentioned sheet conveying device.

The present invention also provides an image forming apparatus including the above-mentioned sheet discharging device.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
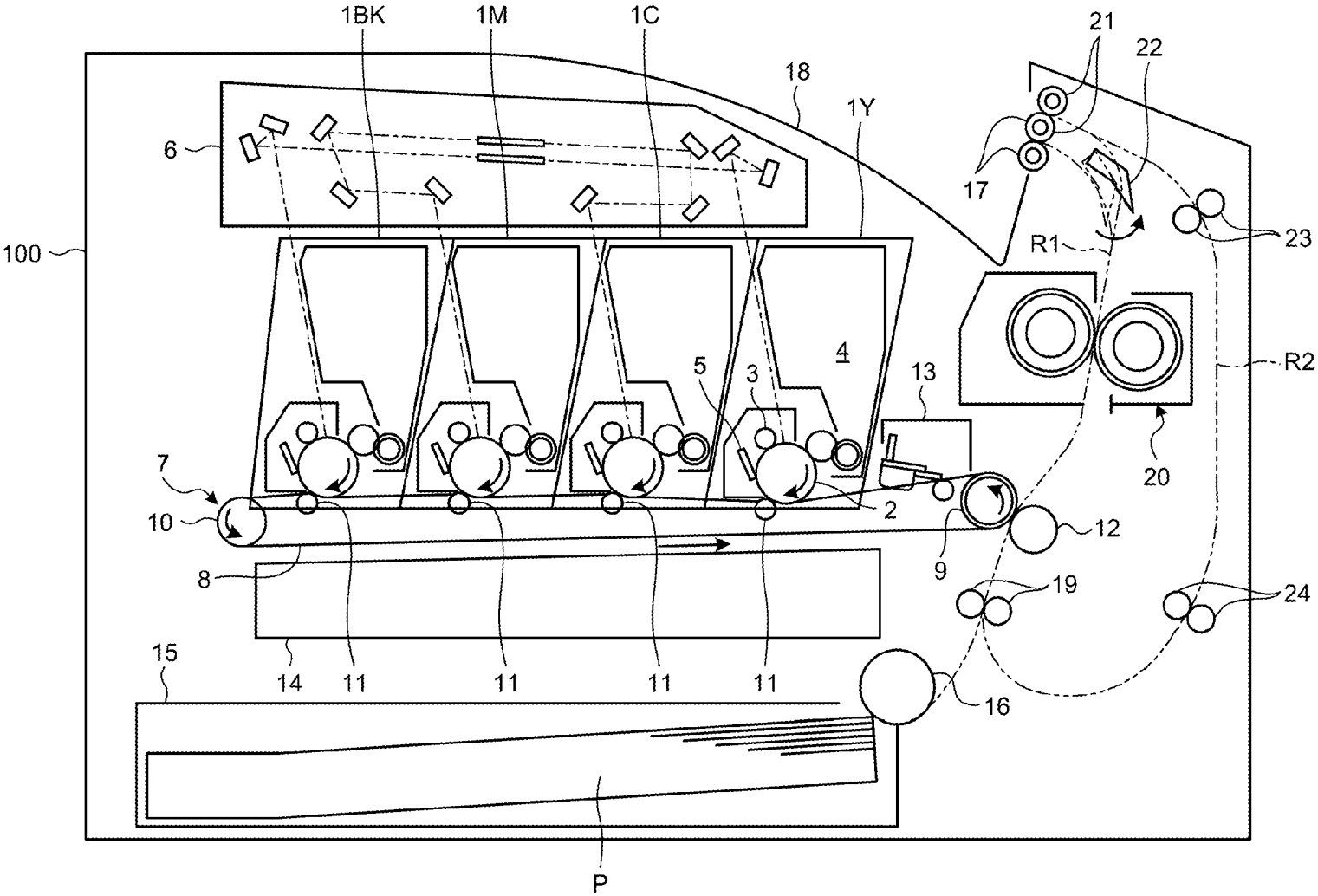
FIG. 1 is a schematic configuration diagram of a color laser printer as an image forming apparatus according to one embodiment of the present invention.

Exemplary embodiments of the present invention are described below with reference to the accompanying drawings. In the drawings, elements such as members and components that are identical in function or shape are denoted by a same reference numeral and/or a symbol so long as they are identifiable, and repeated description is omitted.

FIG. 1 is a schematic configuration diagram of a color laser printer as an image forming apparatus according to one embodiment of the present invention. First, an overall configuration and operations of the color laser printer are described with reference to FIG. 1.

As illustrated in FIG. 1, a main body (main body of the image forming apparatus; hereinafter, "apparatus main body") 100 of the color laser printer includes, at its center, four image forming units 1Y, 1C, 1M, and 1BK that form images of yellow (Y), cyan (C), magenta (M), and black (K), respectively, corresponding to color separation components of a full-color image. Each of the image forming units 1Y, 1C, 1M, and 1BK includes a photosensitive element 2 serving as a latent-image carrier, an electrostatic charging roller 3 serving as an electrostatic charging unit that electrostatically charges a surface of the photosensitive element 2, a developing device 4 serving as a developing unit that develops an electrostatic latent image formed on the photosensitive element 2 by supplying toner thereto, and a cleaning blade 5 serving as a cleaning unit that cleans the surface of the photosensitive element 2.

Note that only the photosensitive element 2, the electrostatic charging roller 3, the developing device 4, and the cleaning blade 5 of the image forming unit 1Y for forming a yellow image are indicated by reference symbols and numerals in FIG. 1, and reference symbols and numerals of the other image forming units 1C, 1M, and 1BK are omitted. In the one embodiment, each of the image forming units 1Y, 1C, 1M, and 1BK is configured as a process unit that is formed integrally with the photosensitive element 2, the electrostatic charging roller 3, the developing device 4, and the cleaning blade 5 and detachably attached to the apparatus main body 100.

Referring to FIG. 1, arranged above the image forming units 1Y, 1C, 1M, and 1BK is an exposure device 6 serving as a latent-image forming unit that forms an electrostatic latent image on the surface of each of the photosensitive elements 2. The exposure device 6 includes a light source, a polygon mirror, an fθ lens, and a reflection mirror. The exposure device 6 is configured to emit laser light onto the surface of each of the photosensitive elements 2 according to image data.

A transfer device 7 serving as a transfer unit that transfers a toner image onto a paper sheet, which is a recording medium, is arranged below the image forming units 1Y, 1M, 1C, and 1BK in FIG. 1. The transfer device 7 includes an intermediate transfer belt 8, which is an endless belt, serving as an intermediate transfer member. The intermediate transfer belt 8 is tensely supported by a plurality of rollers 9 and 10 and configured so as to be driven by one of the rollers 9 and 10 to revolve around (rotate) in a direction indicated by an arrow in FIG. 1.

Four primary transfer rollers 11 serving as primary transfer units are arranged at positions respectively facing the four photosensitive elements 2. The primary transfer rollers 11 respectively press an inner peripheral surface of the intermediate transfer belt 8 at the positions. A primary transfer nip is formed at each of contact points between pressed portions of the intermediate transfer belt 8 and the photosensitive elements 2. Each of the primary transfer rollers 11 is connected to a power supply (not shown), from which a predetermined direct-current (DC) voltage and/or an alternating-current (AC) voltage is to be applied to the primary transfer roller 11.

A secondary transfer roller 12 serving as a secondary transfer unit is arranged to face one (the roller 9 in the configuration illustrated in FIG. 1) of the rollers that tensely support the intermediate transfer belt 8. The secondary transfer roller 12 presses an outer peripheral surface of the intermediate transfer belt 8. A secondary transfer nip is formed at a contact point between the secondary transfer roller 12 and the intermediate transfer belt 8. As in the case of the primary transfer rollers 11, the secondary transfer roller 12 is connected to the power supply (not shown), from which a predetermined DC voltage and/or an AC voltage is applied to the secondary transfer roller 12.

A belt cleaning device 13 that cleans the surface of the intermediate transfer belt 8 is arranged on the outer peripheral surface of the intermediate transfer belt 8 at a position near a right end of the belt 8 in FIG. 1. A waste-toner transfer hose (not shown) extending from the belt cleaning device 13 is connected to an inlet of a waste-toner bin 14 arranged below the transfer device 7.

Arranged in a lower portion of the apparatus main body 100 in FIG. 1 are a sheet feed tray 15 that contains sheets P as a recording medium and a sheet feeding roller 16 that feeds the sheet P from the sheet feed tray 15. The sheet P can be thick paper, a postcard, an envelope, normal paper, thin paper, enamel paper (coated paper, art paper, or the like), tracing paper, or the like. A transparency sheet or film for overhead projection can be used as the recording medium.

A pair of sheet discharging rollers 17 for discharging the recording medium to the outside is arranged in an upper portion of the apparatus main body 100 in FIG. 1. A sheet output tray 18, on which sheets discharged from the apparatus are to be stacked, is provided on a top surface of the apparatus main body 100.

Arranged in the apparatus main body 100 is a conveying path R1 for conveying the sheet P from the sheet feed tray 15 through the secondary transfer nip to the sheet output tray 18. A pair of registration rollers 19 is arranged on the conveying path R1 at a position upstream of the secondary transfer roller 12 in a sheet conveying direction. The registration rollers 19 serve as timing rollers that convey the sheet to the secondary transfer nip at timing appropriate for conveyance. A fixing device 20 for fixing an image that has been transferred onto the sheet but is not fixed yet is arranged at a position downstream of the secondary transfer roller 12 in the sheet conveying direction.

The printer of the one embodiment includes a reversing conveyance mechanism that turns upside down and conveys a sheet to print an image on a back surface of the sheet. More specifically, the printer includes a pair of reverse rollers 21 that conveys the sheet backward, a reverse path R2 for conveying the sheet conveyed backward to an upstream side of the registration rollers 19, and a plurality of pairs of conveying rollers 23 and 24 that conveys the sheet on the reverse path R2. In the illustrated example, one of the pair of sheet discharging rollers 17 functions also as the reverse roller 21. A path switch claw 22 is arranged downstream of the fixing device 20. Path selection can be made between a path for delivering a sheet to between the pair of sheet discharging rollers 17 and a path for delivering the sheet to between the pair of reverse rollers 21 by swinging the path switch claw 22.

Basic operations of the printer according to the one embodiment are described below with reference to FIG. 1.

When an image forming operation is started, each of the photosensitive elements 2 of the image forming units 1Y, 1C, 1M, and 1BK is rotated clockwise in FIG. 1 by a driving device (not shown), and the surface of each of the photosensitive elements 2 is uniformly electrostatically charged by the electrostatic charging roller 3 so as to have a predetermined polarity. The exposure device 6 emits laser light onto the charged surface of each of the photosensitive elements 2 according to image data obtained by an reading apparatus (not shown) by scanning an original document. As a result, an electrostatic latent image is formed on the surface of each of the photosensitive elements 2. Meanwhile, image data, according to which each of the photosensitive elements 2 is exposed to the light, is mono-color image data obtained by performing color separation on a desired full-color image into yellow, cyan, magenta, and black color data. The developing device 4 supplies toner onto the electrostatic latent images formed on the photosensitive elements 2 in this way, whereby the electrostatic latent images are visualized as toner images (developer images).

When the image forming operation is started, the intermediate transfer belt 8 starts rotating in the direction indicated by the arrow in FIG. 1. Moreover, a constant voltage or a constant-current-controlled voltage that is opposite in polarity to the charged toner is applied to each of the primary transfer rollers 11. As a result, a transfer electric field is formed in each of the primary transfer nips.

Thereafter, when the toner images of the respective colors on the photosensitive elements 2 are brought to the corresponding primary transfer nips by rotations of the photosensitive elements 2, the toner images on the photosensitive elements 2 are sequentially transferred onto the intermediate transfer belt 8 and overlaid on one another by the transfer electric fields formed in the primary transfer nips. Thus, a full-color toner image are carried on the surface of the intermediate transfer belt 8. Toner that is not transferred onto the intermediate transfer belt 8 and left on the photosensitive elements 2 is removed by the cleaning blades 5. Subsequently, electrostatic dischargers (not shown) neutralize the surfaces of the photosensitive elements 2, thereby resetting the surface potential for next image formation.

The sheet feeding roller 16 starts rotating to deliver the sheet P from the sheet feed tray 15 to the conveying path R1. The paper P delivered onto the conveying path R1 is conveyed by the pair of registration rollers 19 at adjusted timing to the secondary transfer nip. Meanwhile, a transfer electric field has been formed in the secondary transfer nip by applying to the secondary transfer roller 12 a transfer voltage that is opposite in polarity to the charged toner of the toner images on the intermediate transfer belt 8.

Thereafter, when the toner images on the intermediate transfer belt 8 are brought to the secondary transfer nip by rotation of the intermediate transfer belt 8, the toner images on the intermediate transfer belt 8 are transferred onto the paper P at a time by the transfer electric field formed in the secondary transfer nip.

Thereafter, the paper P is conveyed to the fixing device 20. The fixing device 20 fixes the toner image on the sheet P onto the sheet P. The sheet P is then discharged to the outside of the apparatus by the pair of sheet discharging rollers 17 and stacked on the sheet output tray 18.

When an image is to be printed on the back surface of the sheet, a solenoid (not shown) is energized to swing the path switch claw 22 as indicated in FIG. 1 by a long dashed double-short dashed line, so that the path switch claw 22 guides the sheet, onto front surface (one side) of which a toner image has been fixed, to a nip between the pair of reverse rollers 21. The pair of reverse rollers 21 is then caused to rotate reversely before a trailing end of the sheet has exited the nip between the pair of reverse rollers 21, thereby delivering the sheet to the reverse path R2. The sheet delivered to the reverse path R2 is conveyed by the plurality of pairs of conveying rollers 23 and 24 to the upstream side of the pair of registration rollers 19. Thus, the sheet turned upside down is conveyed into the conveying path R1 again. Thereafter, a toner image is transferred and fixed onto the back surface of the sheet in a manner similar to that described above. The sheet is then guided by the path switch claw 22 having been returned to its original position to between the pair of sheet discharging rollers 17, and discharged onto the sheet output tray 18.

Although the image forming operation for forming a full-color image on a sheet has been described above, a mono-color image can also be formed by using any one of the four image forming units 1Y, 1C, 1M, and 1BK. A two-color or a three-color image can be formed by using two or three of the image forming units.

Figure 2:
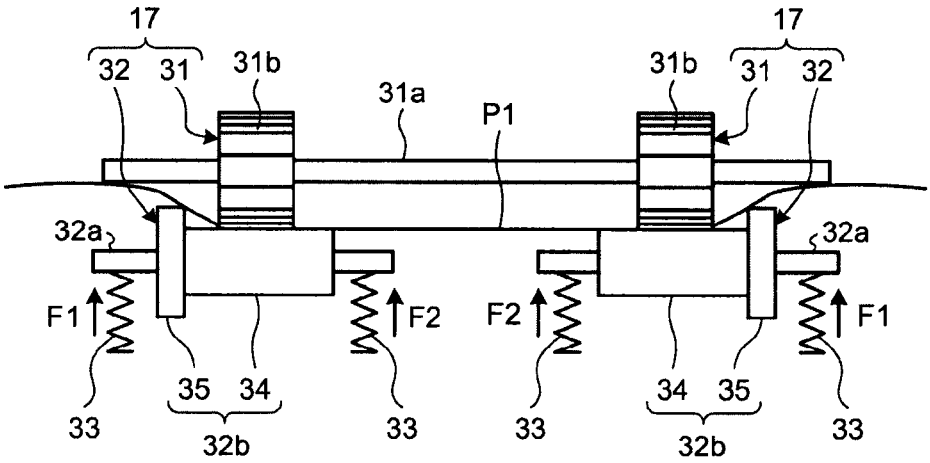
FIG. 2 is a diagram of a sheet discharging device according to the one embodiment as viewed in a sheet conveying direction.

FIG. 2 is a diagram of a sheet discharging device according to the one embodiment as viewed in the sheet conveying direction.

As illustrated in FIG. 2, the pair of sheet discharging rollers 17 of the sheet discharging device includes driving rollers 31, which are first rotating members arranged on an upper side, and driven rollers 32, which are second rotating members arranged on a lower side. In the one embodiment, the number of the driving rollers 31 and the number of the driven rollers 32 are each two, and the two rollers of each pair are arranged and spaced in a rotating axial direction thereof. However, the number of the rollers 31 and the number of the rollers 32 are not limited to two.

The driving roller 31 is configured to be rotated by a driving source (not shown). The driven roller 32 is biased by a biasing unit 33, such as a compression spring, toward and into contact with the driving roller 31. Accordingly, when the driving roller 31 is driven to rotate, the driven roller 32 that is in contact with the driving roller 31 is rotated by rotation of the driving roller 31.

Each of the driving rollers 31 includes a rotating shaft 31*a*, which is common among the driving rollers 31, and a roller portion 31*b* attached to the rotating shaft 31*a* and serving as a conveying portion.

Each of the driven rollers 32 includes a rotating shaft 32*a*, which is provided for each of the driven rollers 32, and a roller portion 32*b* attached to the rotating shaft 32*a* and serving as a conveying portion. Each of the rotating shafts 32*a* of the driven rollers 32 is laid parallel to the rotating shaft 31*a* of the driving rollers 31. Each of the roller portions 32*b* includes a small-diameter portion 34 that faces one of the roller portions 31*b* of the driving roller 31 and a large-diameter portion 35 that is larger in diameter than the small-diameter portion 34. Each of the large-diameter portions 35 is arranged at a position axially outside of the small-diameter portion 34 and axially displaced from the roller portion 31*b* of the driving roller 31.

When a sheet is fed to (a nip) between the pair of sheet discharging rollers 17 configured as described above, as illustrated in FIG. 2, the large-diameter portions 35 lift up both widthwise ends of a sheet P1 higher than a widthwise center of the sheet P1. As a result, rigidity of the sheet P1 being discharged is increased, and therefore the sheet P1 can be discharged to an area distant from an exit of the pair of sheet discharging rollers 17. In short, the large-diameter portions 35 serve as an rigidity providing element that provides rigidity to the sheet P1. Because rigidity is provided to the sheet P1 being discharged in this manner, the sheet P1 is prevented from undesirably staying near the exit of the pair of sheet discharging rollers 17, whereby occurrence of a problem such as sheet jam can be prevented.

In the one embodiment, a sheet is elastically bent in such a manner that a widthwise center portion of the sheet protrudes downward. Alternatively, the sheet can be discharged as being elastically bent in such a manner that the widthwise center portion of the sheet protrudes upward by vertically inverting the arrangement of the driving rollers 31 and the driven rollers 32. It should be noted that elastically bending the sheet so as to protrude downward makes the sheet more stiffened under its own weight than elastically bending the sheet so as to protrude upward and can provide greater rigidity.

As described above, providing rigidity to a sheet using the pair of sheet discharging rollers 17 can increase sheet discharging characteristics and stacking characteristics. However, if a highly-rigid sheet, such as a thick sheet, is discharged by the pair of sheet discharging rollers 17 in a similar manner, damage such as indentation caused by the elastic bending and/or friction can be left in the sheet, which can degrade image quality. In light of this circumstance, in the one embodiment, the pair of sheet discharging rollers 17 is configured as follows to be capable of adapting to conveyance of a highly-rigid sheet. Note that the term "rigidity" means stiffness of the sheet, or, put another way, resilience of the sheet to maintain its flat shape.

Portions characteristic of the one embodiment are described below.

Figure 3:
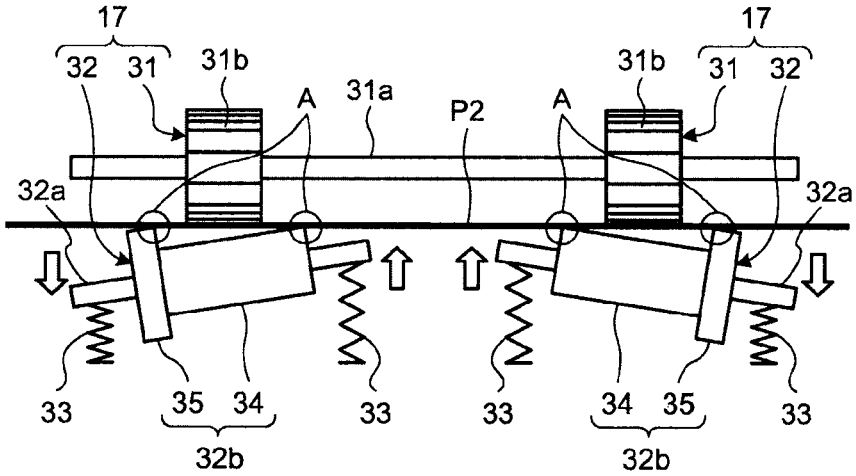
FIG. 3 is a diagram illustrating a pair of sheet discharging rollers in a state where a highly-rigid sheet is passing therebetween.

As illustrated in FIG. 3, the one embodiment is configured as follows. When a highly-rigid sheet P2 is fed, each of the driven rollers 32 changes its orientation to an orientation where the rotating shaft 32*a* of the driven roller 32 is tilted relative to the rotating shaft 31*a* of the driving rollers 31 as viewed in the sheet conveying direction, thereby moving a position of an end portion of the driven roller 32 on the side of the large-diameter portion 35 away from the rotating shaft 31*a* of the driving rollers 31.

More specifically, each of the driven rollers 32 is configured such that both end portions (the end portion on the side of the large-diameter portion 35 and an end portion on the opposite side) of the rotating shaft 32*a* are configured to be movable toward or away from the rotating shaft 31*a* of the driving rollers 31 independently of each other. The biasing units 33 that bias the both end portions of the rotating shaft 32*a* of the driven roller 32 are also configured to bias the end portions independently of each other. This configuration allows the driven roller 32 to tilt relative to the driving roller 31.

Accordingly, as illustrated in FIG. 3, when the highly-rigid sheet P2 is fed to between the pair of sheet discharging rollers 17, rigidity of the sheet P2 pushes down the large-diameter portions 35 away from the rotating shaft 31*a* of the driving rollers 31. Consequently, the end portion of each of the driven rollers 32 on the side of the large-diameter portion 35 is pushed down. Conversely, the end portion of the driven roller 32 on the side opposite to the large-diameter portion 35 is pushed up. As a result, each of the driven rollers 32 is brought into contact with the conveyed sheet P2 at an outer periphery of the large-diameter portion 35 and at an outer periphery of an end portion of the small-diameter portion 34 on the side opposite to the large-diameter portion 35. Put another way, according to the one embodiment, the sheet P2 is discharged in a state contacting the driven rollers 32 at four points indicated by reference symbol A in FIG. 3.

As described above, according to the one embodiment, when a highly-rigid sheet is discharged, the large-diameter portions 35 are pushed by the sheet to retreat away from the driving rollers 31. Accordingly, damage to the sheet caused by the large-diameter portions 35 can be lessened. As a result, indentation left by elastic bending and/or friction is reduced, and quality of an image on the highly-rigid sheet can be maintained favorably.

Figure 10:
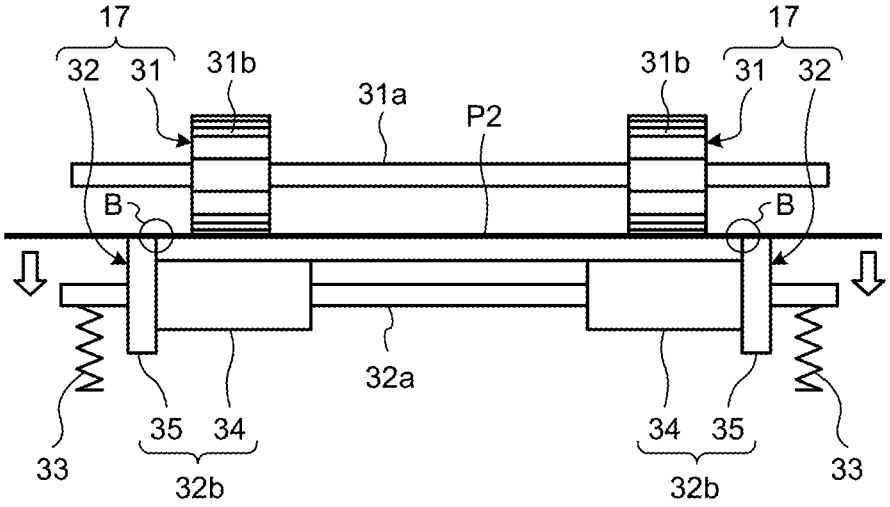
FIG. 10 is a diagram illustrating a configuration of a sheet discharging device of a comparative example.

FIG. 10 is a diagram illustrating a configuration of a sheet discharging device of a comparative example.

In the comparative example illustrated in FIG. 10, being different from the one embodiment described above, the single rotating shaft 32*a* is shared by the driven rollers 32. In the comparative example, the biasing units 33 bias the driven rollers 32 at both end portions of the shared rotating shaft 32*a* toward the driving rollers 31. Except these, the comparative example is similar to the one embodiment in configuration.

In the comparative example, when the highly-rigid sheet P2 is fed to between the pair of sheet discharging rollers 17, rigidity of the sheet P2 pushes down the large-diameter portions 35 away from the rotating shaft 31*a* of the driving rollers 31 as same as in the one embodiment. However, in the comparative example, the two driven rollers 32 are formed integrally into one piece via the shared rotating shaft 32*a*. Therefore, the driven rollers 32 are pushed down while keeping parallel relation to the rotating shaft 31*a* of the driving rollers 31.

In the comparative example, as described above, the driven rollers 32 do not tilt relative to the driving rollers 31 in contrast to the one embodiment. Accordingly, the small-diameter portions 34 do not contact the sheet P2 being conveyed, but only the outer peripheries of the large-diameter portions 35 contact the sheet P2. Put another way, in the comparative example, the driven rollers 32 contact the sheet P2 at two points indicated by reference symbol B in FIG. 10. Therefore, pressing forces applied by the biasing units 33 concentrate at these two points.

In contrast thereto, in the one embodiment of the present invention, the driven rollers 32 contact a highly-rigid sheet at the four points as described above. The greater the number of contact points with a sheet, the more pressing force applied to the sheet can be dispersed. Therefore, on an assumption that a sum of biasing forces applied by the biasing units 33 of the one embodiment is equal to that of the comparative example, a contact pressure per contact point on a sheet of the one embodiment is smaller than that of the comparative example. Accordingly, the one embodiment can reduce dent, indentation left by friction, and the like in the sheet resulting from contact between the driven rollers 32 and the sheet more effectively than the comparative example. Such a configuration as that of the one embodiment is particularly favorable for an apparatus that performs face-down sheet discharging, or, more specifically, discharging a sheet printed-image-side face down (facing the driven rollers 32). This is because such a configuration can lessen an adverse effect on the image side.

Figure 4:
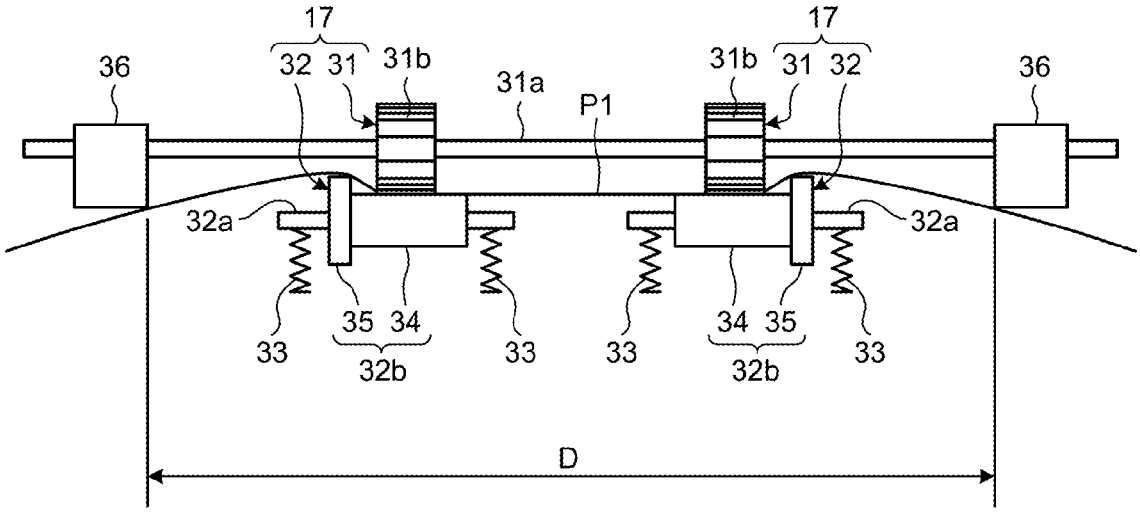
FIG. 4 is a diagram illustrating a configuration of a sheet discharging device according to another embodiment of the present invention, the sheet discharging device being viewed in the sheet conveying direction.
Figure 5:
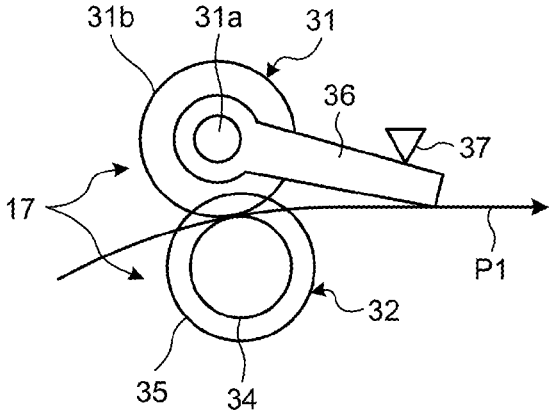
FIG. 5 is a diagram illustrating a configuration of a sheet discharging device according to the another embodiment as viewed in an axial direction of the pair of sheet discharging rollers.

FIGS. 4 and 5 illustrate a configuration of a sheet discharging device according to another embodiment of the present invention.

FIG. 4 is a diagram of the sheet discharging device as viewed in the sheet conveying direction. FIG. 5 is a simplified view of the sheet discharging device as viewed in the axial direction of the pair of sheet discharging rollers 17.

As illustrated in FIG. 4, the sheet discharging device according to the another embodiment includes a pair of retaining members 36 arranged on the rotating shaft 31*a* of the driving rollers 31. Each of the retaining members 36 is arranged at a position axially outside of the roller portion 31*b* of the driving roller 31 (and axially displaced from the large-diameter portion 35).

As illustrated in FIG. 5, the retaining members 36 are arranged in a manner to extend downstream in the sheet conveying direction from the rotating shaft 31*a* of the driving rollers 31. Distal ends of the retaining members 36 are to come into contact with the sheet P1 on a side of the sheet P1 opposite to a side where the large-diameter portions 35 contact the sheet P1. The retaining members 36 are also configured to be rotatable about the rotating shaft 31*a* of the driving rollers 31. However, a limiting element 37 limits further upward swinging (in a direction moving away from a sheet passage path) of the distal ends of the retaining members 36 than a predetermined position.

In the another embodiment, when a sheet P1 is fed to between the pair of sheet discharging rollers 17, the sheet P1 is lifted up by the large-diameter portions 35 of the driven rollers 32; in addition, the sheet P1 is pushed down at portions outside of the lifted-up portions in the width direction by the retaining members 36. As a result, the sheet P1 is discharged in an elastically bent state, in which a portion of the sheet P1 between the large-diameter portions 35 protrudes downward but portions of the sheet P1 between the large-diameter portions 35 and the retaining members 36 protrude upward.

As described above, as compared with the configuration that does not include the retaining members 36, the configuration including the retaining members 36 is widened in area where rigidity can be provided. Accordingly, the configuration can provide sufficient rigidity to even a sheet having a large width size and, therefore, is enhanced in sheet discharging characteristics and stacking characteristics. Referring to FIG. 4, rigidity can be provided to a sheet of which width size is larger than spacing D, which represents spacing between the retaining members 36 in the axial direction. This spacing D can be determined as appropriate depending on a width size of a sheet, to which rigidity is to be provided at sheet discharging.

The another embodiment illustrated in FIGS. 4 and 5 is similar to the one embodiment illustrated in FIGS. 1 to 3 except for the difference described above. Therefore, also in the another embodiment illustrated in FIGS. 4 and 5, when a highly-rigid sheet is fed, the driven rollers 32 tilt, causing the large-diameter portions 35 to retreat away from the driving rollers 31 as in the one embodiment. Accordingly, damage to the sheet caused by the large-diameter portions 35 can be lessened.

The retaining members 36 may be configured to be detachably mounted onto the rotating shaft 31*a* of the driving rollers 31. When this configuration is employed, the retaining members 36 can be removed in a situation where it is unnecessary to provide rigidity to, in particular, a sheet having a large width size. As a result, it becomes possible to avoid nonessential risk of degradation in image quality or the like that would otherwise be caused by sliding contact between the retaining members 36 and the sheet.

Figure 6:
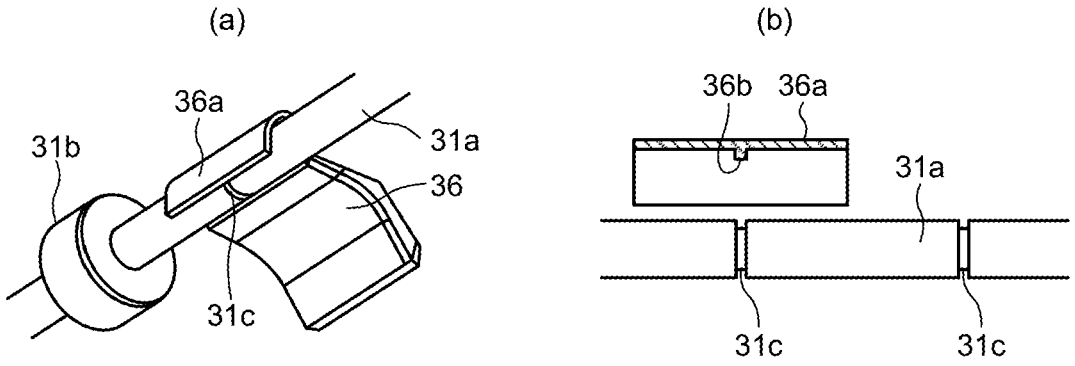
FIGS. 6(*a*) and 6(*b*) are diagrams illustrating a configuration, in which a retaining member is detachable, FIG. 6(*a*) being a perspective view of the configuration, and FIG. 6(*b*) being a cross-sectional view of the retaining member.

More specifically, as illustrated in FIG. 6(*a*), the retaining member 36 is configured to include a mounting portion 36*a* that is C-shaped in cross section and has an opening slightly smaller than an outer diameter of the rotating shaft 31*a* of the driving rollers 31. The mounting portion 36*a* is elastically deformable in a manner to widen the opening when mounted. By applying what is generally referred to as a snap-in scheme to the mounting portion 36*a* as described above, mounting and dismounting can be facilitated.

The configuration may further include, as illustrated in FIG. 6(*b*), positioning grooves 31*c* defined in an outer periphery of the rotating shaft 31*a* of the driving rollers 31, and protrusions 36*b* to be fitted in the positioning grooves 31*c* formed on the mounting portions 36*a* of the retaining members 36. With this configuration, positioning of the retaining members 36 can be performed in the axial direction.

A plurality of the positioning grooves 31*c* spaced in the axial direction of the rotating shaft 31*a* may be provided. This configuration allows changing the position where the retaining member 36 is mounted in the axial direction by fitting the protrusion 36*b* of the retaining member 36 in selected one of the plurality of positioning grooves 31*c*.

For instance, in a situation where a sheet having a large surface area is to be discharged, frictional sliding contact between a leading end of the sheet and a preceding sheet having already been stacked can lessen the effect of the elastic bending during discharging. In this case, a trailing end of the sheet can stay near the exit and block the exit, causing paper jam to occur. However, such a paper jam problem as that described above can be solved by increasing rigidity of the sheet by moving the retaining members 36 axially inward from current positions to narrow an area where the elastic bending is applied.

Figure 7:
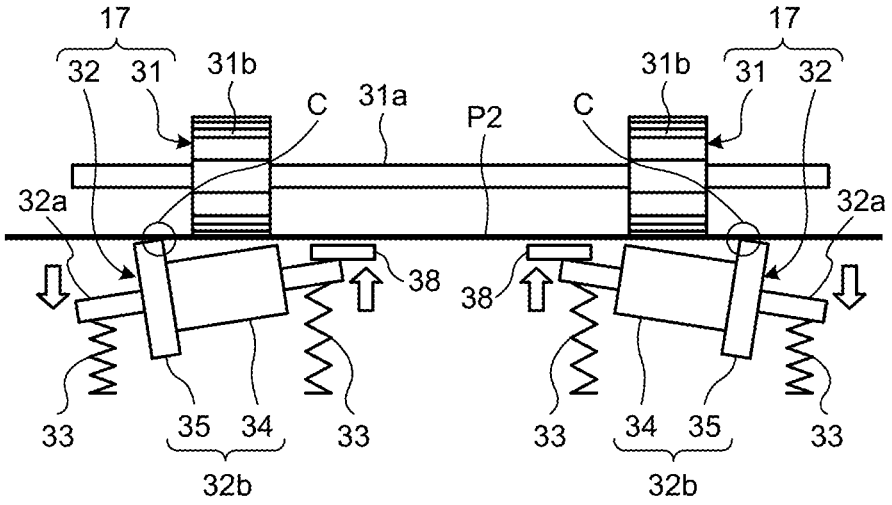
FIG. 7 is a diagram illustrating a configuration of a sheet discharging device according to still another embodiment of the present invention, the sheet discharging device being viewed in the sheet conveying direction.

FIG. 7 is a diagram illustrating a configuration of a sheet discharging device according to still another embodiment of the present invention.

As illustrated in FIG. 7, the sheet discharging device according to the still another embodiment includes contact elements 38, each of which is to come into contact with the axially-inner end portion (on the side opposite to the large-diameter portion 35) of the rotating shaft 32*a* of the driven roller 32. Except this, the still another embodiment is similar to the one embodiment illustrated in FIGS. 1 to 3.

In the still another embodiment, when the highly-rigid sheet P2 is fed to between the pair of sheet discharging rollers 17, the end portion of each of the driven rollers 32 on the side of the large-diameter portion 35 is pushed down as in the one embodiment. As a result, the end portion of the driven roller 32 on the opposite side is pushed up into contact with the contact element 38. This contact limits further upward motion (approaching the rotating shaft 32*a* of the driving roller 31) of the pushed-up end portion, and the end portion is stopped at a predetermined position. As a result, in a state where the driven roller 32 is in the orientation tilted relative to the driving roller 31, the outer periphery of the large-diameter portion 35 contacts the sheet P2 being conveyed, but the end portion of the small-diameter portion 34 on the side opposite to the large-diameter portion 35 is kept out of contact with the sheet P2 being conveyed. Accordingly, in the still another embodiment, the driven rollers 32 contact the sheet P2 at two points indicated by reference symbol C in FIG. 7 in contrast to the one embodiment.

As described above, in the still another embodiment illustrated in FIG. 7, the number of contact points where each of the driven rollers 32 contacts the sheet P2 is small as compared with the one embodiment. However, in the still another embodiment, in each of the driven rollers 32, a pressing force applied by the biasing unit 33 that biases the end portion of the driven roller 32 on the side opposite to the large-diameter portion 35 is received by the contact element 38. Accordingly, an increase in magnitude of the pressing force received by the sheet P2 at the contact point C can be reduced. As a result, dent, indentation left by friction, and the like in a sheet resulting from contact between the large-diameter portions 35 and the sheet can be reduced.

Because the pressing force is received by each of the contact elements 38, a load torque applied to the pair of sheet discharging rollers 17 from the sheet can be reduced. In theory, the higher the rigidity of a sheet, the greater the load toque of the pair of rollers. For this reason, when a heavy load is applied to a driving motor for conveyance of a highly-rigid sheet, the motor can be stopped due to under torque margin at a worst case. However, if the configuration of the still another embodiment illustrated in FIG. 7 is employed, the pressing force applied from the biasing unit 33 is received by the contact element 38 when a highly-rigid sheet is discharged. Because the load torque can be reduced, favorable conveying characteristics and discharging characteristics can be maintained.

Meanwhile, the greater an outer diameter of a portion where the driven roller 32 contacts the contact element 38, the greater a PV value (a product of a contact pressure P and a rotation speed V), and the more likely to cause wear between the driven roller 32 and the contact element 38. In light of this, in the still another embodiment, the PV value is reduced to reduce wear by causing each of the driven rollers 32 to contact the contact element 38 at the rotating shaft 32*a* that is still smaller than the small-diameter portion 34 in outer diameter, so that functions can be maintained favorably over a long period of time. Furthermore, this also allows reducing the load torque of the driven rollers 32.

Figure 8:
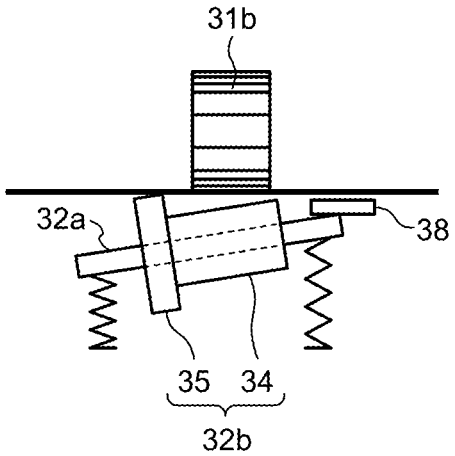
FIG. 8 is a diagram illustrating a configuration, in which a rotating shaft is fixed so as not to rotate.

As illustrated in FIG. 8, there may be employed a configuration, in which the rotating shaft 32*a* of the driven roller 32 extends through the roller portion 32*b* to make the roller portion 32*b* rotatable relative to the rotating shaft 32*a*. With this configuration, the rotating shaft 32*a* can be fixed so as not to rotate. In this case, because the driven roller 32 can contact the contact element 38 at the rotating shaft 32*a* that is fixed so as not to rotate, sliding contact between the driven roller 32 and the contact element 38 will not occur. As a result, such wear as that described above caused by sliding contact with the contact element 38 can be prevented, and, simultaneously, further reduction in the load torque of the driven roller 32 can be achieved.

The embodiments of the present invention have been described above; however, the present invention is not limited to the embodiments described above and, as a matter of course, various modifications can be made without departing from the scope of the present invention. In each of the embodiments described above, the biasing force applied to the end portion of the driven roller 32 on the side of the large-diameter portion 35 and the biasing force applied to the end portion on the opposite side are equal to each other. Alternatively, these biasing forces, a sum of which remain unchanged, may differ from each other. If, in the state where the driven roller 32 is arranged parallel to the driving rollers 31 as illustrated in FIG. 2, a biasing force applied to the axially-outer end portion of the driven roller 32 is denoted by F1 and a biasing force applied to the axially-inner end portion of the driven roller 32 is denoted by F2, the pressing force applied by the large-diameter portion 35 onto a sheet can be reduced by, for example, setting F1 and F2 so as to satisfy F1<F2. In this case, further reduction in dent, indentation left by friction, and the like in the sheet can be achieved. Conversely, when F1 and F2 are set so as to satisfy F1>F2, the biasing force applied by the large-diameter portion 35 onto the driving roller 31 increases. In this case, the large-diameter portion 35 is less easily pushed down by the sheet, making it possible to provide rigidity even to a sheet having relatively high rigidity.

Figure 9:
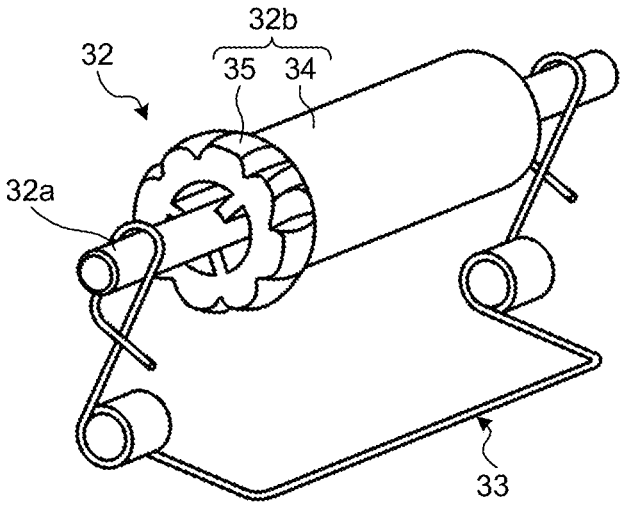
FIG. 9 is a diagram illustrating a configuration, in which biasing units that bias respective end portions are integrally formed into one piece.

The biasing unit 33 that biases the end portion of the driven roller 32 on the side of the large-diameter portion 35 and the biasing unit 33 that biases the end portion on the opposite side may be formed integrally as a single member. More specifically, it is preferable to use such a double torsion spring, which is formed by connecting two torsion coil springs, as that illustrated in FIG. 9 as the biasing units 33. In this case, by connecting the biasing units 33 that bias the end portions so as to assume a three-dimensional structure, not only stabilizing orientation but also increasing relative positional accuracy of the biasing units 33 can be achieved. In a situation where a certain level of variations in biasing force is tolerable, cost reduction can be achieved by employing a leaf spring as the biasing units 33 formed integrally as such a single member.

A material of the rotating shafts 32*a* of the driven rollers 32 may differ from a material of the roller portions 32*b* (more specifically, the small-diameter portions 34 and the large-diameter portions 35). For instance, by making the roller portions 32*b* of a material, such as a polyacetal, that exhibits high sliding property against a sheet and making the rotating shafts 32*a* of a metal material, such as SUM (Steel Use Machineability) or SUS (Steel Use Stainless), that exhibits high rigidity and smoothed surface, noise caused by sliding contact against the contact elements 38 can be reduced.

Although not illustrated in the drawings, the configuration of the still another embodiment illustrated in FIG. 7 can additionally include the retaining members 36 illustrated in FIGS. 4 and 5.

Applications of each of the embodiments are not limited to sheet discharging devices but can include sheet conveying devices of various units of image forming apparatuses. Image forming methods employable by image forming apparatuses, to which the embodiments are applied, are not limited to such an electrophotographic method as described above. The embodiments are applicable to apparatuses using other image forming methods, e.g., an inkjet method. The image forming apparatus is not limited to a printer but can be a copying machine, a facsimile machine, or a multifunction peripheral having two or more functions of these machines. The embodiments are also applicable to image reading apparatuses (scanners), automatic document feeders, other sheet conveying devices that convey sheets, and other sheet discharging devices that discharge sheets.

As described above, in an aspect of the embodiments, a second rotating member that includes a large-diameter portion and a small-diameter portion is capable of changing its orientation to an orientation where a rotating shaft of the second rotating member is tilted relative to a rotating shaft of a first rotating member as viewed in a sheet conveying direction, thereby moving the position of an end portion of the second rotating member on the side of the large-diameter portion away from the rotating shaft of the first rotating member. Accordingly, if a force that presses the large-diameter portion applied by rigidity of a sheet passing through between the first rotating member and the second rotating member exceeds a biasing force applied by a biasing unit, the position of the large-diameter portion can be moved away from the first rotating member. Accordingly, damage to the sheet can be lessened.

In another aspect of the embodiments, in the state where the second rotating member is in the orientation where the rotating shaft of the second rotating member is tilted relative to the rotating shaft of the first rotating member, the large-diameter portion and an end portion of the small-diameter portion on the side opposite to the large-diameter contact the sheet being conveyed. This configuration allows dispersing a pressing force applied to the sheet, whereby dent, indentation left by friction, and the like in the sheet are effectively reduced.

In still another aspect of the embodiments, there is provided a contact element that comes into contact with an end portion of the second rotating member on the side opposite to the large-diameter portion in the state, in which the second rotating member is in the orientation where the rotating shaft of the second rotating member is tilted relative to the rotating shaft of the first rotating member. Accordingly, a pressing force applied by the biasing unit can be received by the contact element. As a result, it becomes possible to effectively reduce dent, indentation left by friction, and the like in the sheet by reducing the pressing force applied to the sheet. Furthermore, in this case, a load torque of the second rotating member is also reduced, and therefore favorable conveying characteristics can be maintained.

In the configuration including the contact element, the second rotating member may preferably come into contact with the contact element at a portion of the second rotating member, the portion being smaller in outer diameter than the small-diameter portion. With this configuration, wear caused by sliding contact between the contact element and the second rotating member can be reduced, and therefore functions can be maintained favorably over a long period of time. Furthermore, reducing the load torque of the second rotating member can also be achieved.

In the configuration including the contact element, the second rotating member may preferably come into contact with the contact element at a portion of the second rotating member, the portion being fixed so as not to rotate. With this configuration, wear caused by sliding contact with the contact element can be prevented, and, simultaneously, further reduction in the load torque of the second rotating member can be achieved.

In still another aspect of the embodiments, the biasing force applied to the end portion on the side of the large-diameter portion is greater than the biasing force applied to the end portion on the opposite side. With this configuration, the biasing force from the large-diameter portion toward the first rotating member can be increased. As a result, the large-diameter portion becomes less likely to retreat, and it become possible to provide rigidity even to a sheet having relatively high rigidity.

In still another aspect of the embodiments, conversely, the biasing force applied to the end portion on the opposite side is greater than the biasing force applied to the end portion on the side of the large-diameter portion. With this configuration, the pressing force applied from the large-diameter portion to the sheet can be reduced. As a result, dent and indentation left by friction in the sheet can be further reduced.

In still another aspect of the embodiments, a retaining member is provided at a position axially displaced from the large-diameter portion. The retaining member retains the sheet by contacting the sheet on a side opposite to a side where the large-diameter portion contacts the sheet. This configuration allows providing sufficient rigidity to even a sheet that is large in width size.

The retaining member may preferably be configured to be detachably mounted onto the rotating shaft of the first rotating member, so that the retaining member can be detached in a situation where the retaining member is unnecessary. This configuration allows avoiding nonessential quality-related risk that would otherwise be caused by sliding contact between the retaining member and the sheet.

The position at which the retaining member is mounted may preferably be axially changeable. With this configuration, the retaining member can be arranged at a position suitable for a width size of the sheet.

According to an aspect of the present invention, if a force pressing a large-diameter portion applied by rigidity of a sheet passing through between a first rotating member and a second rotating member exceeds a biasing force applied by a biasing unit, a position of the large-diameter portion can be moved away from the first rotating member. As a result, damage to the sheet can be lessened.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet conveying device comprising:

a first rotating member;

a second rotating member including two separate rollers facing the first rotating member, each of the two separate rollers rotating about a different shaft; and a biasing component configured to bias the two separate rollers toward the first rotating member, wherein the first rotating member and the second rotating member pinch a sheet therebetween and convey the pinched sheet in a sheet conveying direction, each of the two separate rollers includes, a small-diameter portion facing the first rotating member, and only one large-diameter portion arranged at a position axially displaced from a position at which the first rotating member and the second rotating member pinch the sheet, the large-diameter portion of each of the two separate rollers being arranged on a side of the small-diameter portion that is opposite a side of the small-diameter portion facing the other one of the two separate rollers, the large-diameter portion having a diameter larger than a diameter of the small-diameter portion, an outer surface of the large-diameter portion of each of the two separate rollers being parallel to a rotating shaft around which the large-diameter portion and the small-diameter portion rotate, and each of the two separate rollers is configured to be capable of changing to an orientation where the rotating shaft of each of the two separate rollers is tilted relative to a rotating shaft of the first rotating member as viewed in the sheet conveying direction, thereby moving a position of an end portion of each of the two separate rollers on a side of the respective large-diameter portion away from the rotating shaft of the first rotating member.

2. The sheet conveying device according to claim 1, wherein, in a state, in which each of the two separate rollers is in the orientation, an end portion of the respective small-diameter portion on a side opposite to the respective large-diameter portion contact the sheet.

3. The sheet conveying device according to claim 1, further comprising:

a contact element configured to, when each of the two separate rollers is on its way to changing to the orientation where the rotating shaft of each of the two separate rollers is tilted relative to the rotating shaft of the first rotating member, come into contact with the end portion of each of the two separate rollers on a side opposite to the respective large-diameter portion to put a limit on approach of the end portion each of the two separate rollers on the opposite side toward the rotating shaft of the first rotating member as viewed in the sheet conveying direction, wherein in a state, in which each of the two separate rollers is in the orientation where the rotating shaft of each of the two separate rollers is tilted relative to the rotating shaft of the first rotating member, the respective large-diameter portion contacts the sheet being conveyed, but an end portion of the respective small-diameter portion on a side opposite to the respective large-diameter portion is kept out of contact with the sheet by the contact between the contact element and the two separate rollers.

4. The sheet conveying device according to claim 3, wherein each of the two separate rollers comes into contact with the contact element at a portion of each of the two separate rollers, the portion being smaller than the respective small-diameter portion in outer diameter.

5. The sheet conveying device according to claim 3, wherein each of the two separate rollers comes into contact with the contact element at a portion of each of the two separate rollers, the portion being fixed so as not to rotate.

6. The sheet conveying device according to claim 1, wherein the biasing component is configured to, bias the end portion of each of the two separate rollers on the side of the respective large-diameter portion with a first biasing force, and bias an end portion on a side opposite to the side of the respective large-diameter portion with a second biasing force, the first and second biasing forces being applied independently of each other.

7. The sheet conveying device according to claim 6, wherein the first biasing force is less than the second biasing force.

8. The sheet conveying according to claim 6, wherein the biasing force applied to the end portion on the opposite side is greater than the biasing force applied to the end portion on the side of the respective large-diameter portion.

9. The sheet conveying according to claim 1, further comprising:

a retaining member configured to be arranged at a position axially displaced from the respective large-diameter portion, the retaining member retaining the sheet by contacting the sheet on a side of the sheet opposite to a side where the respective large-diameter portion contacts the sheet.

10. The sheet conveying according to claim 9, wherein the retaining member is configured to be detachably mounted onto the rotating shaft of the first rotating member.

11. The sheet conveying according to claim 9, wherein the position at which the retaining member is mounted is axially changeable.

12. The sheet conveying device according to claim 1, wherein a material of the rotating shaft of each of the two separate rollers differs from a material of the respective small-diameter portion and the respective large-diameter portion.

13. The sheet conveying according to claim 1, further comprising:

an additional first rotating member, arranged and spaced apart from the first rotating member on the rotary shaft of the first rotating member in an axial direction.

14. An image forming apparatus comprising:

the sheet conveying device according to claim 1.

15. A sheet discharging device comprising:

a first rotating member;

a second rotating member including two separate rollers facing the first rotating member, each of the two separate rollers rotating about a different shaft; and a biasing component configured to bias the two separate rollers toward the first rotating member, wherein the first rotating member and the second rotating member pinch a sheet therebetween and convey the pinched sheet in a sheet conveying direction to discharge the sheet to outside of the sheet discharging device, each of the two separate rollers includes, a small-diameter portion facing the first rotating member, and only one large-diameter portion arranged at a position axially displaced from a position at which the first rotating member and the second rotating member pinch the sheet, the large-diameter portion of each of the two separate rollers being arranged on a side of the small-diameter portion that is opposite a side of the small-diameter portion facing the other one of the two separate rollers, the large-diameter portion having a diameter larger than a diameter of the small-diameter portion, an outer surface of the large-diameter portion of each of the two separate rollers being parallel to a rotating shaft around which the large-diameter portion and the small-diameter portion rotate, and each of the two separate rollers is configured to be capable of changing to an orientation where the rotating shaft of each of the two separate rollers is tilted relative to a rotating shaft of the first rotating member as viewed in the sheet conveying direction, thereby moving a position of an end portion of each of the two separate rollers on a side of the respective large-diameter portion away from the rotating shaft of the first rotating member.

16. An image forming apparatus comprising:

the sheet discharging device according to claim 15.

17. A sheet conveying device comprising:

a first rotating member;

a second rotating member including two separate rollers facing the first rotating member, each of the two separate rollers rotating about a different shaft; and a biasing component configured to bias the two separate rollers toward the first rotating member, wherein each of the two separate rollers includes, a small-diameter portion facing the first rotating member, and only one large-diameter portion arranged at one end of the small-diameter portion, the large-diameter portion of each of the two separate rollers being arranged on a side of the small-diameter portion that is opposite a side of the small-diameter portion facing the other one of the two separate rollers, the large-diameter portion having a diameter larger than a diameter of the small-diameter portion, an outer surface of the large-diameter portion of each of the two separate rollers being parallel to a rotating shaft around which the large-diameter portion and the small-diameter portion rotate, and depending on a type of a paper being fed in between the first and second rotating members, each of the two separate rollers is configured to change to an orientation where the rotating shaft of each of the two separate rollers is tilted relative to a rotating shaft of the first rotating member such that one end of the rotating shaft of each of the two separate rollers is farther away from the rotating shaft of the first rotating member relative to the other end of the rotating shaft of each of the two separate rollers.

18. The sheet conveying device according to claim 17, wherein, when each of the two separate rollers is in the orientation, an end portion of the respective small-diameter portion closer to the other end of the rotating shaft of each of the two separate rollers, contacts the sheet.

19. The sheet conveying device according to claim 17, further comprising:

a first spring attached to the one end of the rotating shaft of each of the two separate rollers; and a second spring attached to the other end of the rotating shaft of each of the two separate rollers, wherein different amount of force is applied to each of the first and second springs to enable the second rotating shaft to change to the orientation.

* * * * *